US007434968B2

(12) United States Patent
Wu

(10) Patent No.: US 7,434,968 B2
(45) Date of Patent: Oct. 14, 2008

(54) TRAFFIC SIGNAL LAMP ASSEMBLY AND METHOD OF REPLACING SAME

(75) Inventor: Chen-Ho Wu, Los Altos Hills, CA (US)

(73) Assignee: Leotek Electronics Corporation, Lung-Tan, Tao-Yuan County (TW)

( * ) Notice: Subject to any disclaimer, the term of this patent is extended or adjusted under 35 U.S.C. 154(b) by 50 days.

(21) Appl. No.: 11/517,690

(22) Filed: Sep. 8, 2006

(65) Prior Publication Data

US 2007/0139921 A1 Jun. 21, 2007

Related U.S. Application Data

(60) Provisional application No. 60/752,944, filed on Dec. 21, 2005.

(51) Int. Cl.
*F21V 17/00* (2006.01)

(52) U.S. Cl. ..... 362/375; 362/545; 362/374; 362/800; 362/238; 362/240; 340/815.45

(58) Field of Classification Search ..... 362/238, 362/240, 800, 252, 649–650, 545, 519, 549, 362/374–375; 340/815.45
See application file for complete search history.

(56) References Cited

U.S. PATENT DOCUMENTS

| | | | | |
|---|---|---|---|---|
| 4,764,854 | A * | 8/1988 | Matsune et al. | 362/649 |
| 6,268,801 | B1 | 7/2001 | Wu | |
| 6,796,698 | B2 | 9/2004 | Sommers et al. | |
| 6,905,227 | B2 | 6/2005 | Wu | |
| 6,911,915 | B2 | 6/2005 | Wu | |
| 2004/0032746 | A1 * | 2/2004 | Kakidaira et al. | 362/548 |
| 2004/0042208 | A1 * | 3/2004 | Wu | 362/245 |

* cited by examiner

*Primary Examiner*—John Anthony Ward
*Assistant Examiner*—Robert May
(74) *Attorney, Agent, or Firm*—DLA Piper LLP (US)

(57) ABSTRACT

A method and apparatus for installing an LED lamp module into a light such as a traffic signal light. The LED lamp module includes a plurality of LEDs for producing light. The traffic signal light includes a housing, a door assembly removably or movably attached to the housing and having an aperture for passing the light, and a securing bracket having a first end secured to the door assembly and a second end secured to the LED lamp module, for maintaining an alignment between the door assembly and the LED lamp module.

7 Claims, 17 Drawing Sheets

TRAFFIC SIGNAL LAMP ASSEMBLY AND METHOD OF REPLACING SAME

This application claims the benefit of U.S. Provisional Application No. 60/752,944, filed Dec. 21, 2005.

FIELD OF THE INVENTION

The present invention relates to the design and the use of light emitting diode (LED) lamps for various traffic signal light applications, and more particularly to an improved LED traffic signal lamp design that better facilitates the removal and replacement of one LED based light engine with another LED based light engine as needed.

BACKGROUND OF THE INVENTION

Light emitting diode (LED) lamps have been developed to replace conventional incandescent or fluorescent lamps for reducing electrical and maintenance costs, and for increasing reliability. LED lamps consume less electrical energy than conventional lamps while exhibiting much longer lifetimes. Such LED lamps typically include a power supply and a plurality of LEDs mounted on a flat or curved surface.

One growing use of LED lamps is the replacement of incandescent light bulbs in traffic signal lamps. A common conventional traffic signal lamp is illustrated in FIGS. 1A and 1B, and includes a housing 1, a front door plate 2, a lens 3, a reflector 4 and an incandescent light bulb 5. Retainers 6 affix the lens 3 to the front door plate 2, which opens via hinges 7 to allow access to the interior of the housing 1. Light bulb 5 screws into electrical socket 8, which is electrically attached to a terminal strip 9, which in turn receives its power from the traffic signal controller.

It is known to replace the incandescent light bulb 5 with an LED lamp, along with the lens 3 since it is designed for the output of an incandescent light bulb. In a conventional traffic signal lamp retrofit procedure, the lens 3, light bulb 5, reflector 4 and socket 8 are all removed, and an LED lamp module 10 is installed to the front door plate 2 to replace lens 3, as illustrated in FIG. 2. Wires 11 from the LED lamp module are connected to the terminal strip 9.

The above mentioned retrofit method has several drawbacks. First, it is time consuming and labor intensive to remove the reflector 4 and socket 8, and access the terminal strip 9 with new wiring. Because traffic is usually blocked in order to access traffic lights, time is of the essence. Second, in order to safely disconnect the socket connector wires from the terminal strip, and connect new wires from the LED lamp module 10 to the terminal strip, the power to the traffic signal must be temporarily turned off, which disrupts traffic flow through the intersection. Finally, once the retrofit is complete, it is not possible to put the original incandescent lamp back in the traffic signal lamp, for example in case a spare LED lamp is not available.

One solution is to insert an LED lamp that utilizes the reflector 4 and socket 8, thus negating the need for their removal, as taught by U.S. Pat. No. 6,796,698. Here, a specially designed LED light source screws directly into the socket connector. The drawbacks to this solution are that the reflector can introduce light loss (especially when contaminated by dirt or deteriorated with age), reflectors can vary among manufacturers necessitating varying LED light source designs, and the LED light source design is complicated and expensive.

Another solution is to utilize a lamp module that mounts to the front door plate of the signal light housing, with a threaded electrical connector compatible with the socket connector, as taught in U.S. Pat. Nos. 6,268,801 and 6,905,227. This solution involves removing the conventional lens and light bulb source, mounting the lamp module to the front door plate, and connecting the threaded electrical connector to the socket connector, which avoids the use of the reflector (and any associated light loss therefrom) while also avoiding the removal of the reflector and socket electrical connector. However, it still requires lens removal and module mounting to the door.

An even simpler solution is the use of an LED lamp with a threaded electrical connector compatible with the socket connector, where the socket connector not only supplies the electrical power, but also provides the sole mechanical support for the LED lamp in the traffic signal housing, as taught in U.S. Pat. No. 6,911,915. Here, the conventional lamp is simply replaced with the LED lamp having the same electrical connection, and a Fresnel lens is mounted to the door that collimates the light so that it just fills and illuminates the outer lens of the traffic signal lamp. The use of the reflector (and any associated light loss) is avoided. Subsequent lamp changes simply involve swapping one LED lamp with another. However, even here there are possible complications. Alignment between the LED lamp and Fresnel lens is important because of the directionality of the light output of the LED lamp (and the avoidance of using the reflector). For traffic signal lamps where the socket connector does not adequately align the LED lamp with the Fresnel lens, light can be wasted (by missing the Fresnel lens), and even illumination of the outer lens may not achieved. Improper socket connector alignment can be a function of inadequate initial alignment or quality control, fatigue with age, extreme shaking (e.g. from wind), or even inadequate mechanical support of the socket connector for supporting the weight of the LED lamp (e.g. the LED lamp sags downwardly after installation and/or with time).

There is a need for a lamp design that reliably aligns and secures an LED lamp to the associated lens(es) while still providing easy removal and installation of the LED lamp.

SUMMARY OF THE INVENTION

The present invention solves the aforementioned problems by providing a securing bracket that positions and secures the LED lamp module to lens(es) and/or front door which it illuminates.

A lamp assembly includes a housing, an LED lamp module disposed in the housing and including a plurality of LEDs for producing light, a door assembly removably or movably attached to the housing and having an aperture for passing the light, and a securing bracket having a first end secured to the door assembly and a second end secured to the LED lamp module for maintaining an alignment between the door assembly and the LED lamp module.

A method of retro-fitting a traffic signal lamp with an LED lamp, where the traffic signal lamp has a housing, a door assembly attached to the housing, a lens attached to the door assembly, a reflector in the housing, a threaded electrical socket connector in the housing, and a threaded light source connected into the socket connector, includes: removing the threaded light source from the threaded socket connector, connecting a threaded LED lamp module into the threaded socket connector, wherein the LED lamp module includes a plurality of LEDs, and securing a first end of a securing bracket to the door assembly and securing a second end of the securing bracket to the LED lamp module for maintaining an alignment between the door assembly and the LED lamp module.

In addition, a method of retro-fitting a traffic signal lamp with an LED lamp, where the traffic signal lamp has a housing, a door assembly attached to the housing, a lens attached to the door assembly, an electrical connector in the housing, and a light source connected to the electrical connector, includes: disconnecting the light source from the electrical connector, connecting an LED lamp module to the electrical connector, wherein the LED lamp module includes a plurality of LEDs, securing a first end of a securing bracket to the door assembly and securing a second end of the securing bracket to the LED lamp module for maintaining an alignment between the door assembly and the LED lamp module.

Other objects and features of the present invention will become apparent by a review of the specification, claims and appended figures.

DETAILED DESCRIPTION OF THE PREFERRED EMBODIMENTS

The present invention is traffic signal lamp utilizing an LED lamp that is secured in place relative to the lens(es) that it illuminates. This improved design makes replacement of traffic signal lights quick and highly cost effective compared to the existing LED retrofit signal lamps presently available.

Figure 1A:
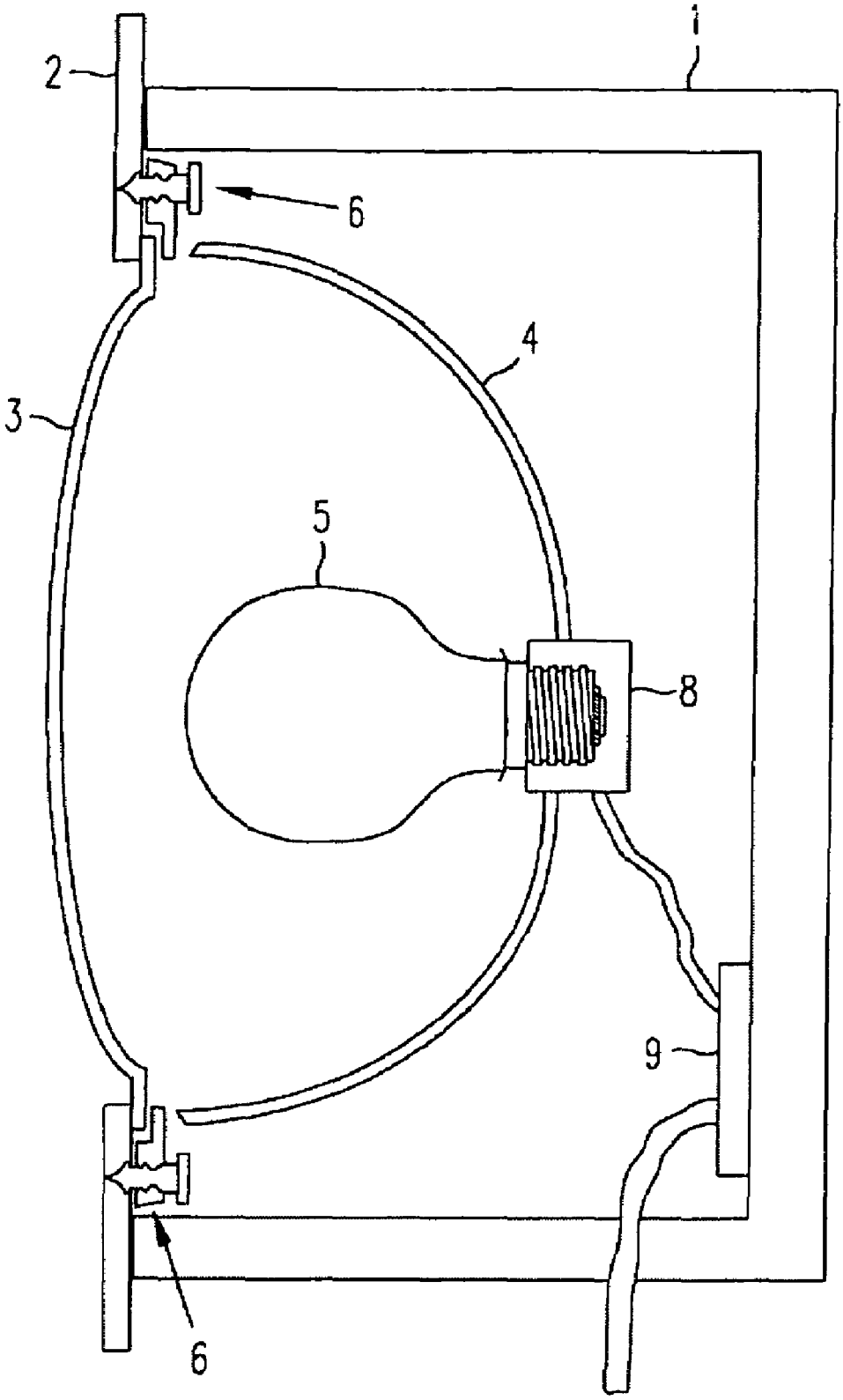
FIG. 1A (Prior Art)
FIG. 1A is a side cross-sectional view of a conventional traffic signal lamp.
Figure 1B:
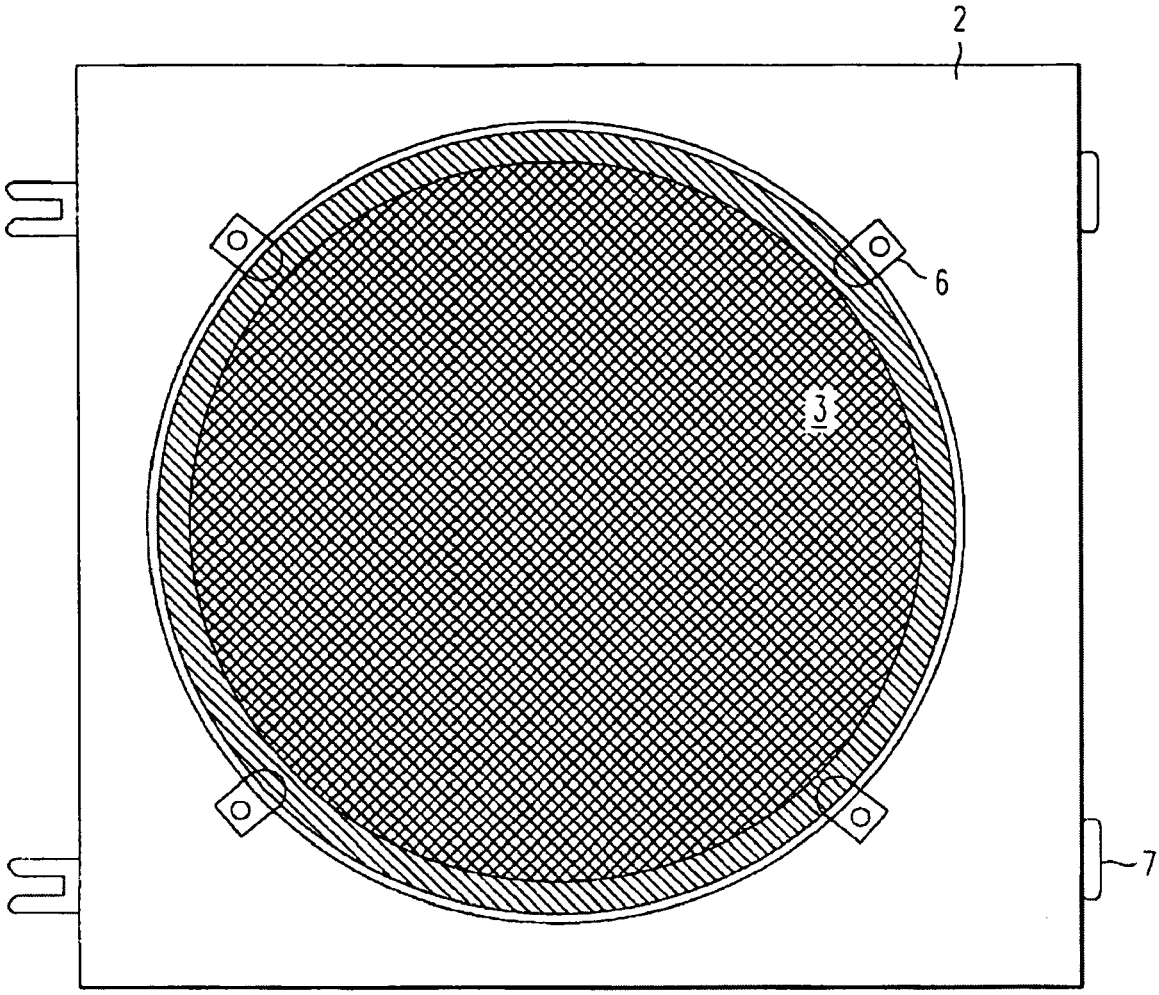
FIG. 1B (Prior Art)
FIG. 1B is a back view of a front door from a conventional traffic signal lamp.
Figure 2:
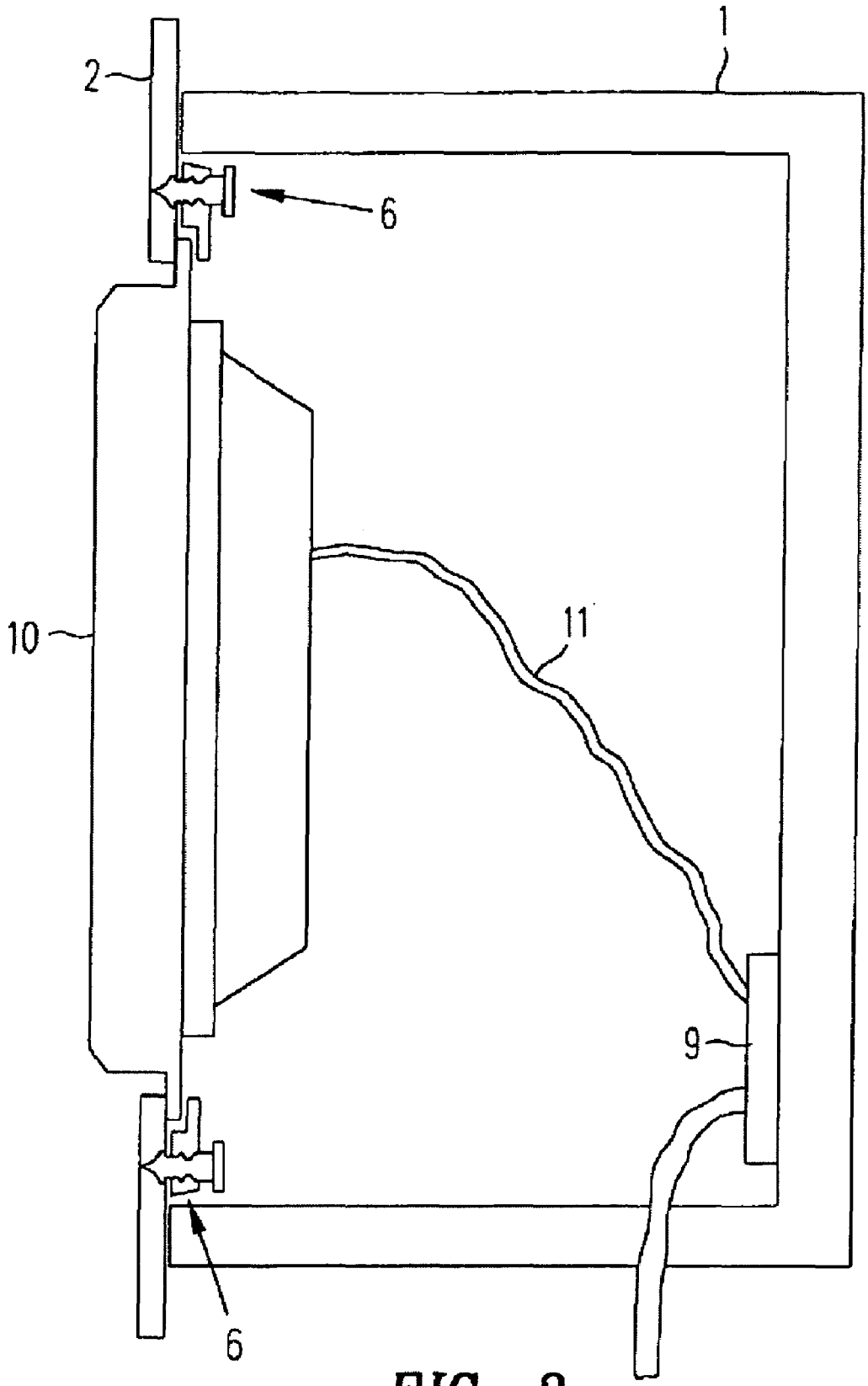
FIG. 2 (Prior Art)
FIG. 2 is a side cross-sectional view of a conventional traffic signal lamp containing a conventional LED lamp module.
Figure 3:
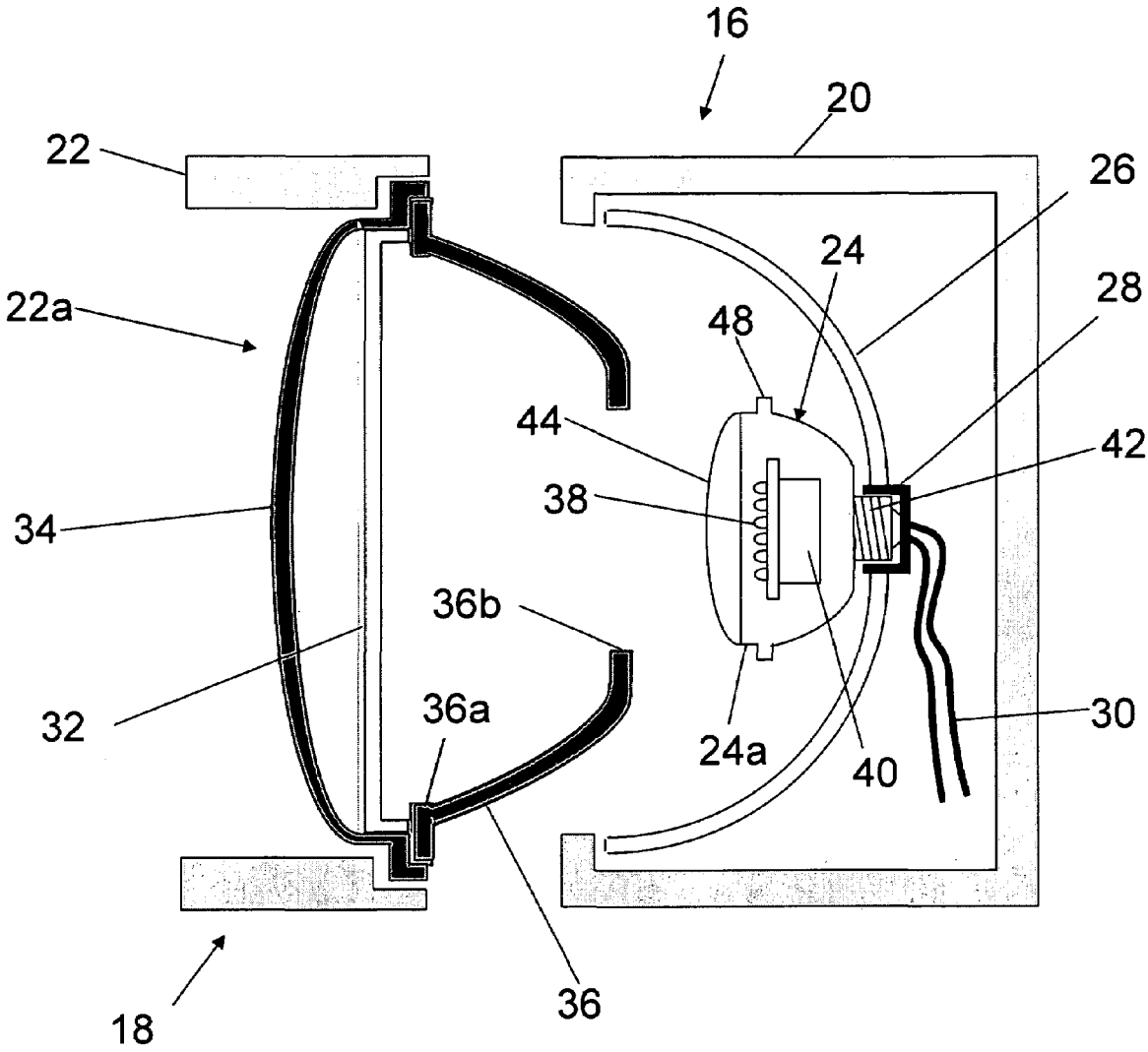
FIG. 3 is a side cross-sectional view of a traffic signal lamp assembly with a secured LED lamp module, with the front door open.
Figure 4:
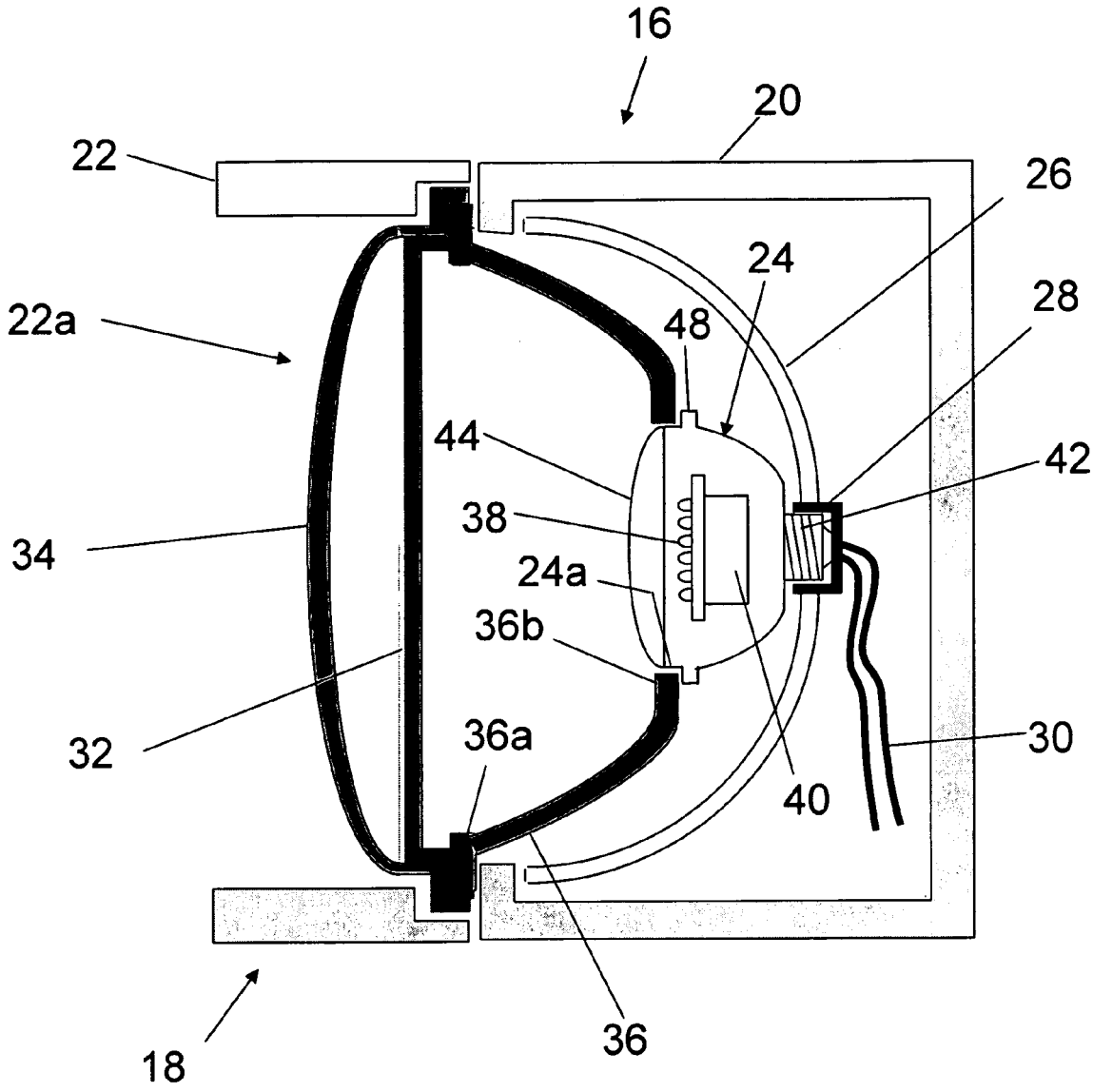
FIG. 4 is a side cross-sectional view of the traffic signal lamp assembly with the secured LED lamp module, with the front door closed.

FIGS. 3-4 illustrate a first embodiment of the traffic signal lamp assembly 16, which includes a front door assembly 18 and a housing 20, which together include a front door 22 (with an aperture 22*a* through which light will pass), an LED lamp module 24, a reflector 26, a threaded socket connector 28, wires 30 (for supplying power to socket connector 28), inner and outer lenses 32/34 (in the front door aperture 22*a*), and securing bracket 36. The front door assembly 18 (which includes the front door 22, lenses 32/34, and securing bracket 36) removably or movably attaches to the housing 20 (via securing retainers, hinge(s), etc.—not shown), which allows easy access to the interior of the housing 20. LED lamp module 24 includes a plurality of light emitting diodes (LEDs) 38 powered by an internal power supply 40 that receives power from a threaded electrical connector 42 (that screws into socket connector 28). The LEDs 38 can be exposed, or can be covered by a lens 44 as shown that can be clear, translucent, and/or have optical focusing power. Inner lens 32 can be a focusing lens such as a Fresnel lens, that directs the light from the LEDs 38 to illuminate outer lens 34 (which can be a colored lens with or without focusing power) in the desired manner.

FIG. 3 illustrates the traffic signal lamp assembly 16 with front door assembly 18 in its open configuration, in which the interior of the housing 20 can be accessed. FIG. 4 illustrates the front door assembly 18 in its closed position (to secure and possibly seal the housing 20). In the closed position, the securing bracket 36 secures the LED lamp module 24 in proper position relative to the front door assembly 18, assuring proper alignment thereto. More specifically, securing bracket 36 has a first end 36*a* which is secured to the front door assembly 18 via a retaining member, adhesive, etc. Securing bracket 36 has a second end 36*b* that engages with the LED lamp module 24 when the front door assembly 18 is closed over housing 20, thus securing the LED lamp module 24 in proper position (vertically, horizontally, and in distance) relative to the front door assembly 18 (and more particularly to lenses 32/34).

Figure 5A:
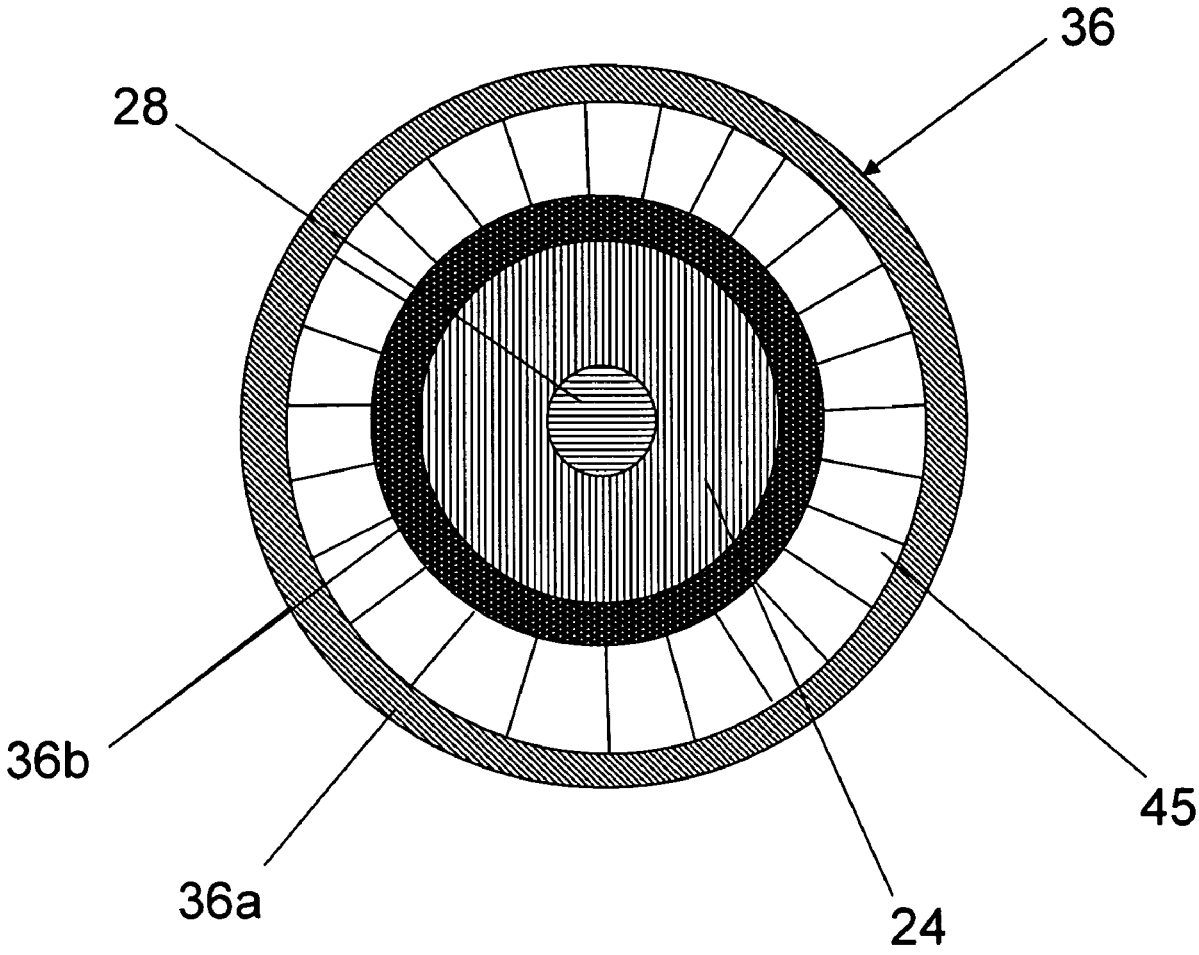
FIG. 5A is a back view of the LED lamp module secured by the securing bracket utilizing a solid conical shaped member.
Figure 5B:
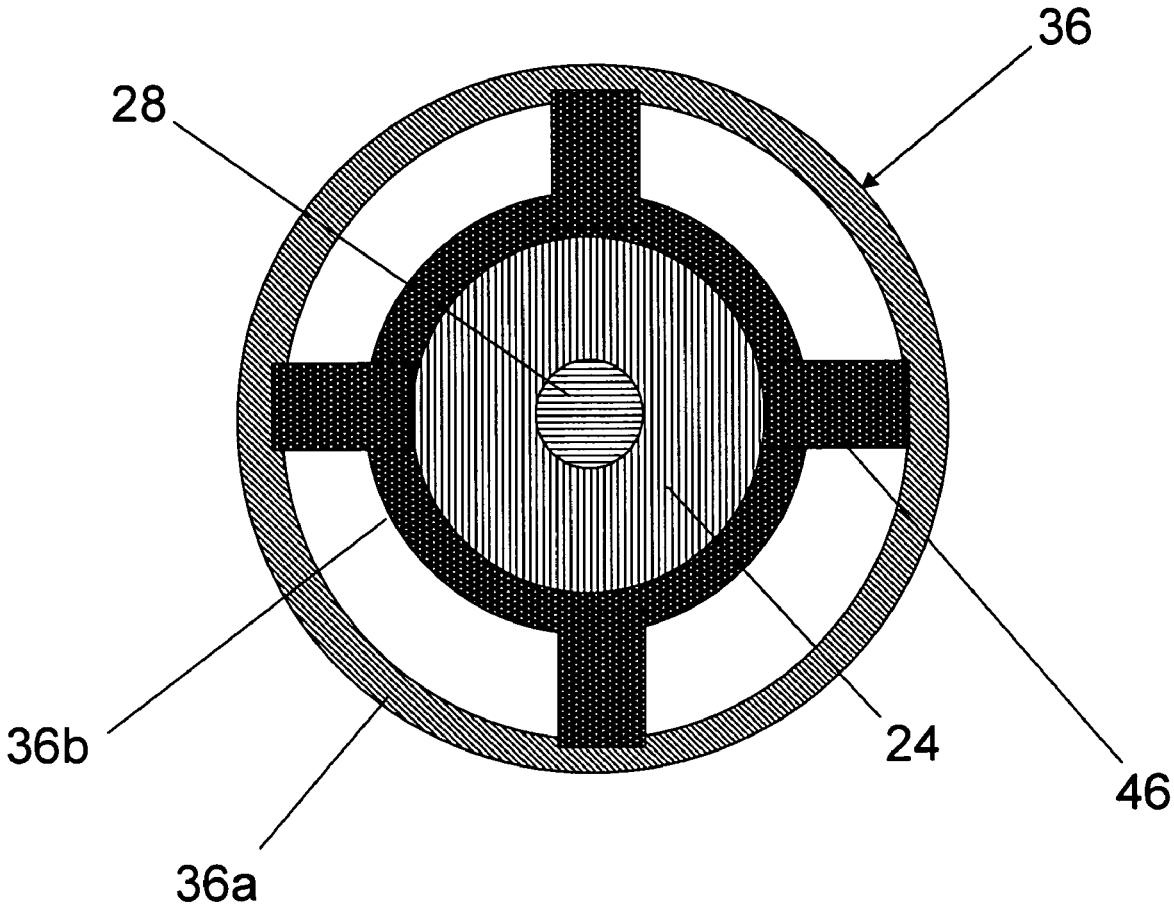
FIG. 5B is a back view of the LED lamp module secured by the securing bracket utilizing a plurality of support arms.

In the illustrated embodiment, first and second ends 36*a* and 36*b* are shaped as annular rings, joined together by either a solid conical shaped member 45 (as shown in FIG. 5A) or by individual arms 46 (as shown in FIG. 5B). Ring shaped first end 36*a* is affixed to the circumference of the front door 22 and/or lenses 32 or 34. Ring shaped second end 36*b* engages the circular side surface 24*a* of the LED lamp module 24, and preferably, but not necessarily, an annular flange 48 extending from the LED lamp module side surface 24*a*, as best illustrated in FIGS. 3-4. With this configuration, the interior of the housing 20 can be conveniently accessed when the front door 22 is open (allowing for the LED lamp module 24 to be conveniently installed or replaced), and the LED lamp module 24 is held in proper alignment to lenses 32/34 (vertically, horizontally, and in distance) when the front door 22 is closed (where displacement of the LED lamp module 24 caused by lamp weight, mounting fatigue, housing vibration, etc. is avoided). Rotational orientation of the LED lamp module 24 and/or lenses 32 or 34 may be required depending on the optical design and the required light output pattern.

Although two lenses 32/34 are shown, any number of lenses (with or without focusing power) can be utilized depending on the application. In fact, even no housing lens need be used. The traffic signal lamp assembly 16 can not only be a standard sized 12 inch or 8 inch traffic signal light, but it can also be used in pedestrian signs, arrow signs, commercial signs, non-standard sized traffic lights, etc. The LED lamp module 24 need not include power supply 40, which can either be external or absent should the power from wires 30 be of the required voltage. Other quick disconnect electrical connectors can be used instead of threaded electrical connectors 28/42. For example, such connectors could be push and twist type, with one or more pins of one connector engaging a shaped channel of the other connector.

Figure 6:
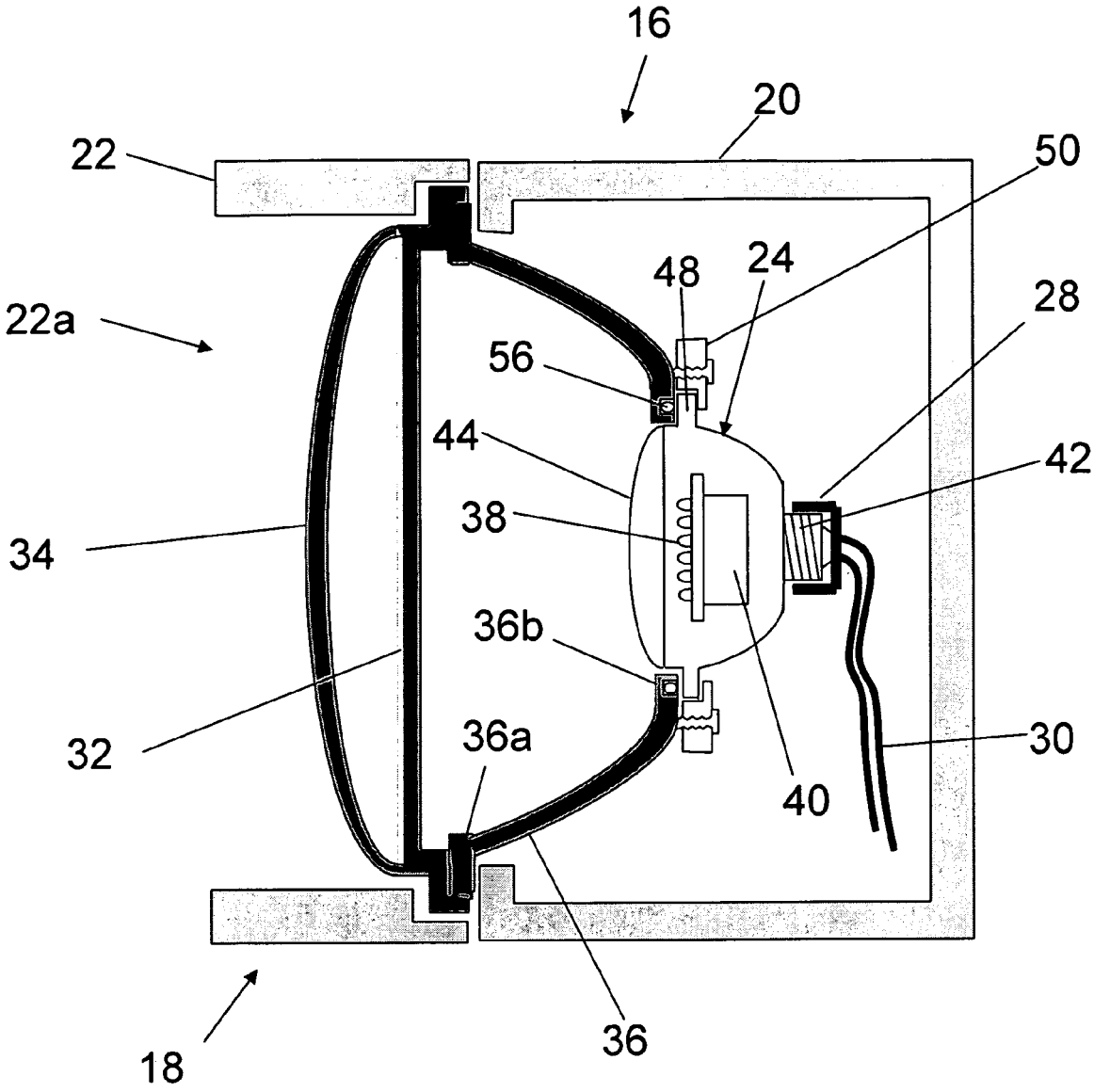
FIG. 6 is a side cross-sectional view of a first alternate embodiment of the traffic signal lamp assembly with the secured LED lamp module.
Figure 7:
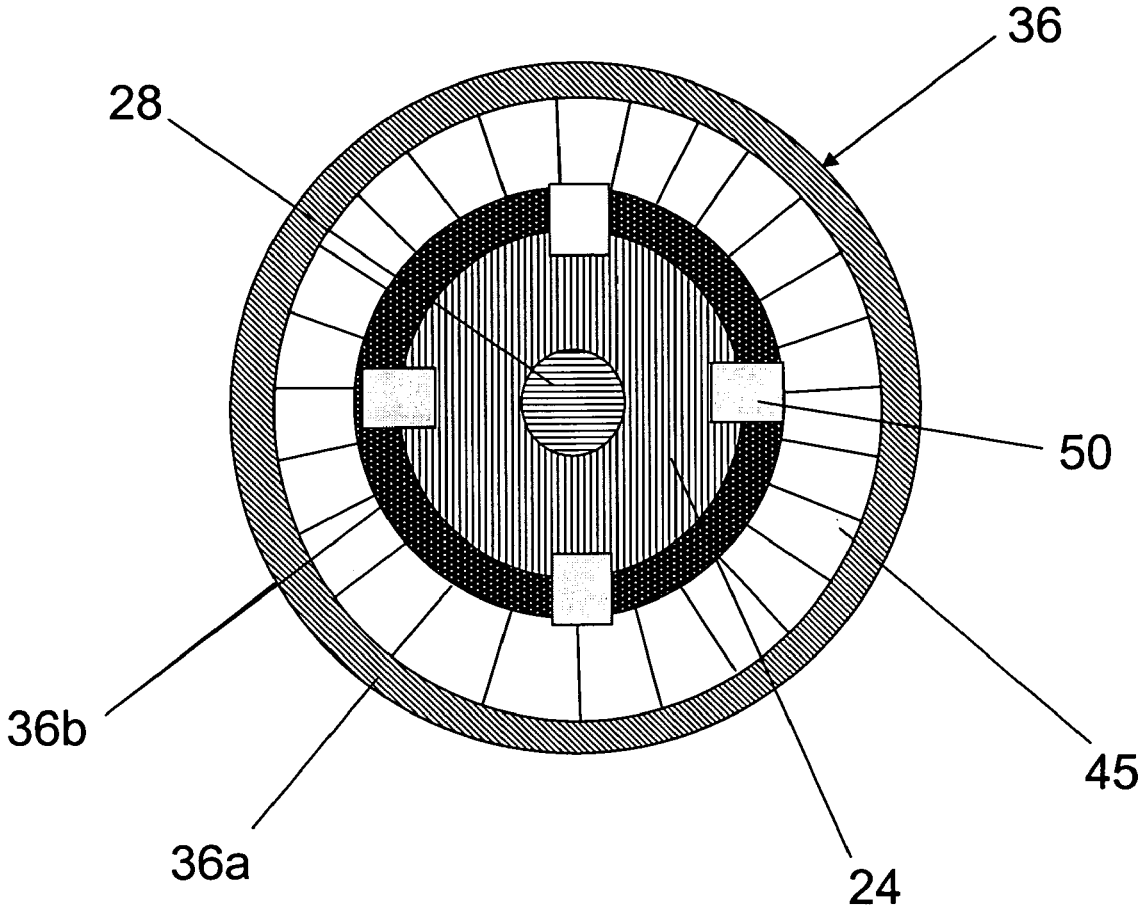
FIG. 7 is a back view of the first alternate embodiment of the LED lamp module secured by the securing bracket.

FIGS. 6-7 illustrate another embodiment similar to that above, but without a fixed socket connector 28 (i.e. reflector 26 not present or previously removed). In this embodiment, the LED lamp module 24 is affixed to the securing bracket 36 (e.g. while the front door 22 is open) using one or more retainer members 50. The socket connector 28, at the free ends of wires 30, is connected to threaded connector 42 either before or after the LED light module 24 is affixed to the securing bracket 36. Here, the alignment of the LED lamp module 24 to the lenses 32/34 can be created, confirmed, and/or adjusted before the front door 22 is closed. An optional seal member 56 (e.g. gasket, rubber o-ring, etc.) can be engaged between the securing bracket 36 and LED lamp module 24 as shown to seal the cavity formed by these elements and lens 32. This seal cavity keeps the lens 44 clean, and even allows lens 44 to be omitted to expose the LEDs 38.

Figure 8A:
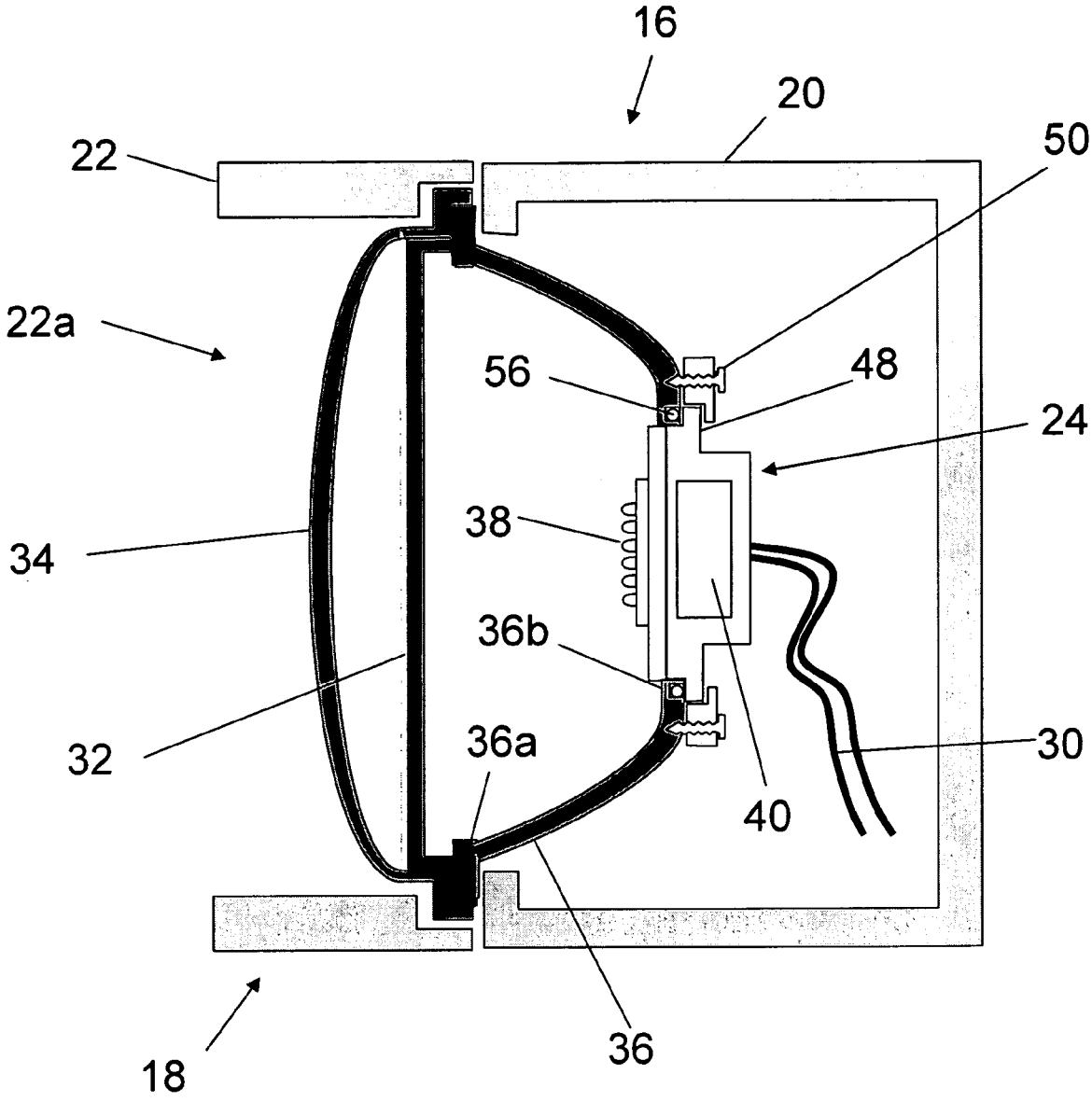
FIG. 8A is a side cross-sectional view of a second alternate embodiment of the traffic signal lamp assembly with the secured LED lamp module.
Figure 8B:
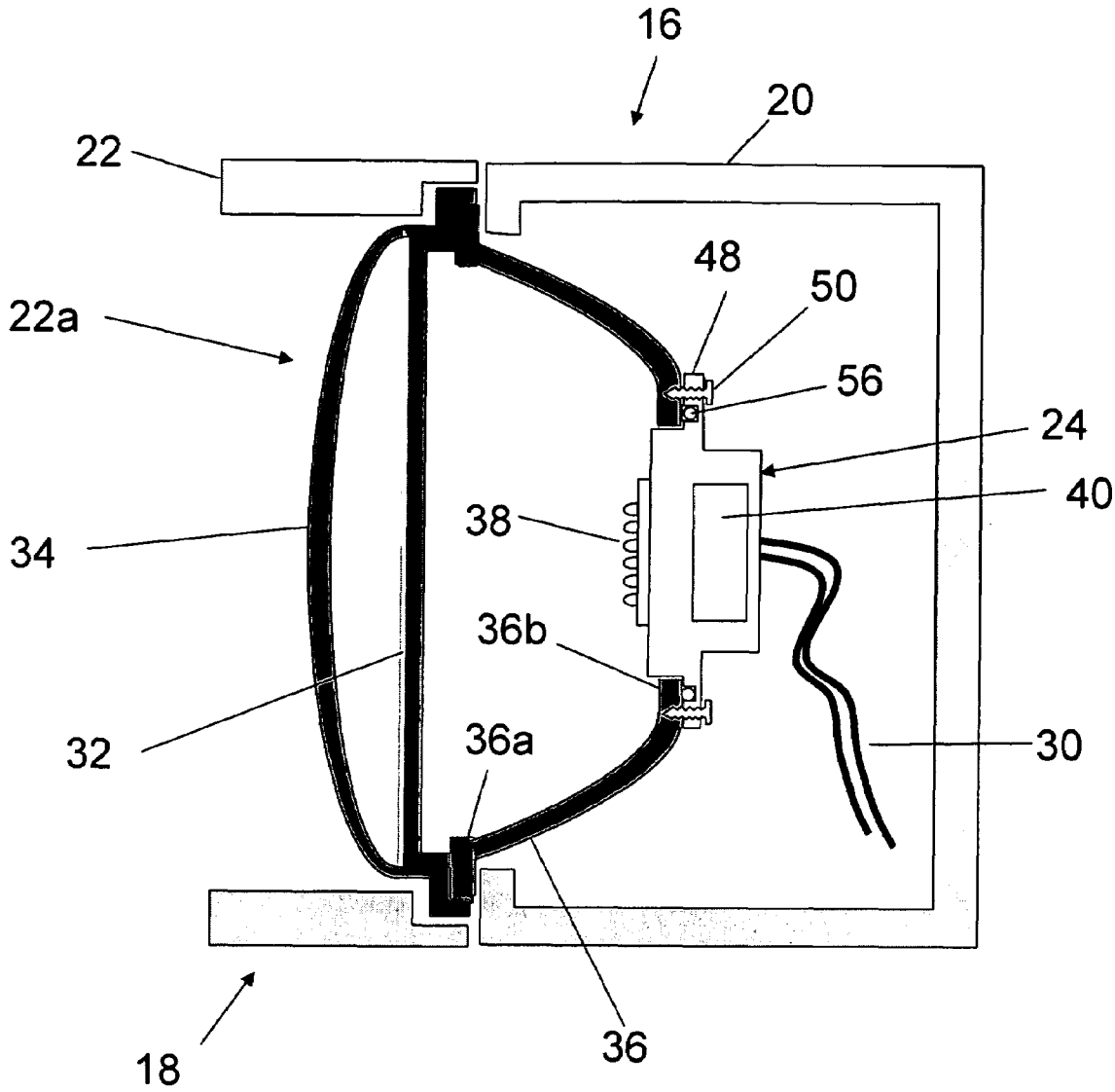
FIG. 8B is a side cross-sectional view of a third alternate embodiment of the traffic signal lamp assembly with the secured LED lamp module.

FIG. 8A illustrates yet another embodiment, where the LED lamp module 24 has no lens over the LEDs 38, and no threaded electrical connector. Instead, the wires 30 enter the LED lamp module housing, and the LEDs 36 are exposed. With this configuration, it may be preferable for the securing bracket 36 to form an air tight seal between inner lens 32 and LED lamp module 24 (i.e. either being formed integrally, sealed or bonded with glue or other adhesive, using seal members 56, etc.), in order to protect the LEDs 38 and associated circuitry from moisture. The embodiment shown in FIG. 8B is essentially the same as that in FIG. 8A, except the retaining member 50 consists simply of a screw or bolt securing the flange 48 to the securing bracket 36.

Figure 8C:
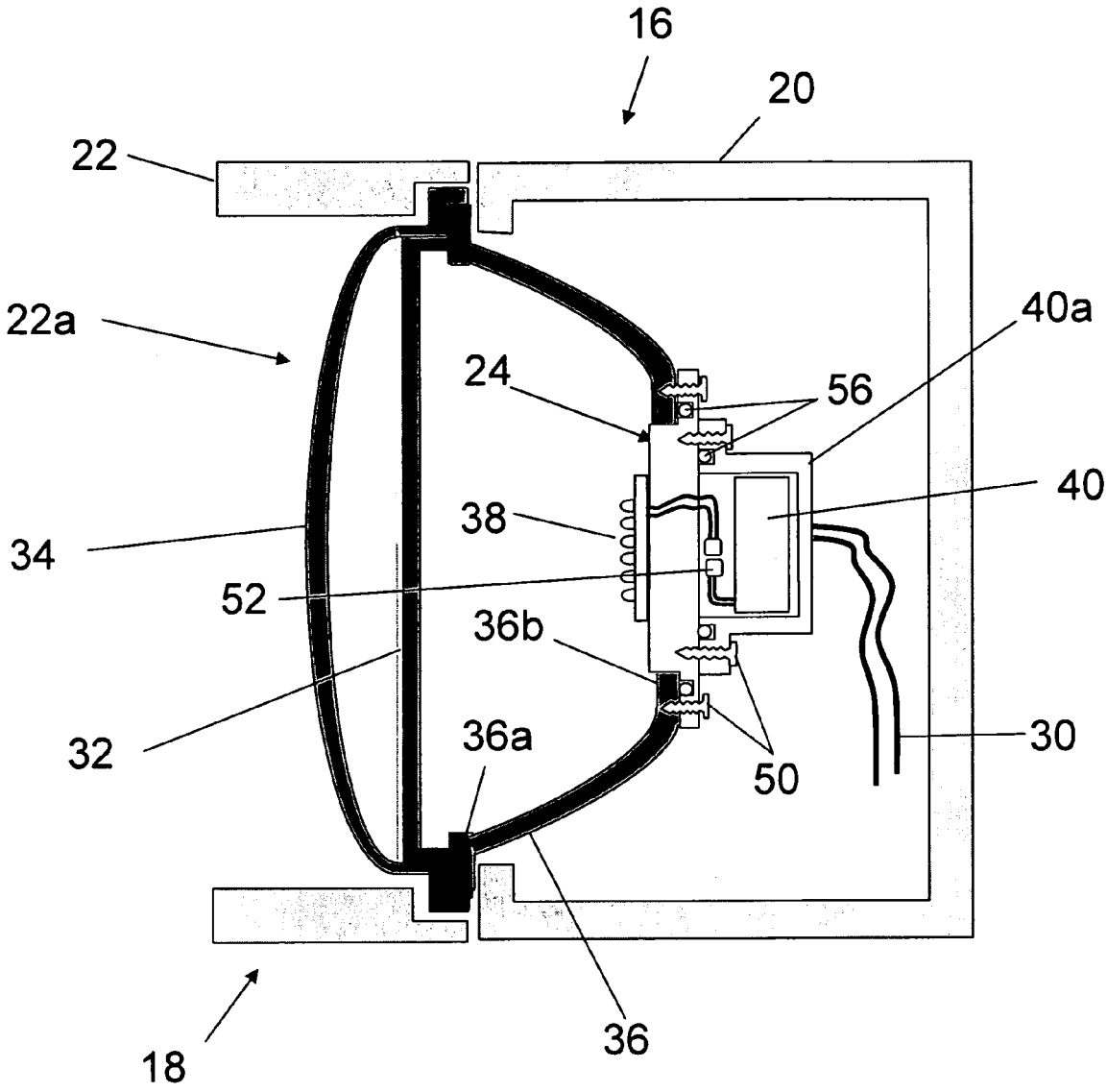
FIG. 8C is a side cross-sectional view of a fourth alternate embodiment of the traffic signal lamp assembly with the secured LED lamp module.

FIG. 8C illustrates yet another embodiment, where the power supply 40 is housed in a separate housing 40*a* that removably attaches to the main portion of LED lamp module 24 via retainer members 50 (and optionally seal member 56). Power supply 40 is connected to the LEDs 38 via a quick disconnect electrical connector 52. With this embodiment, if the power supply 40 fails, just it can be easily accessed, removed and replaced, without having to remove and replace the rest of the LED module 24

Figure 8D:
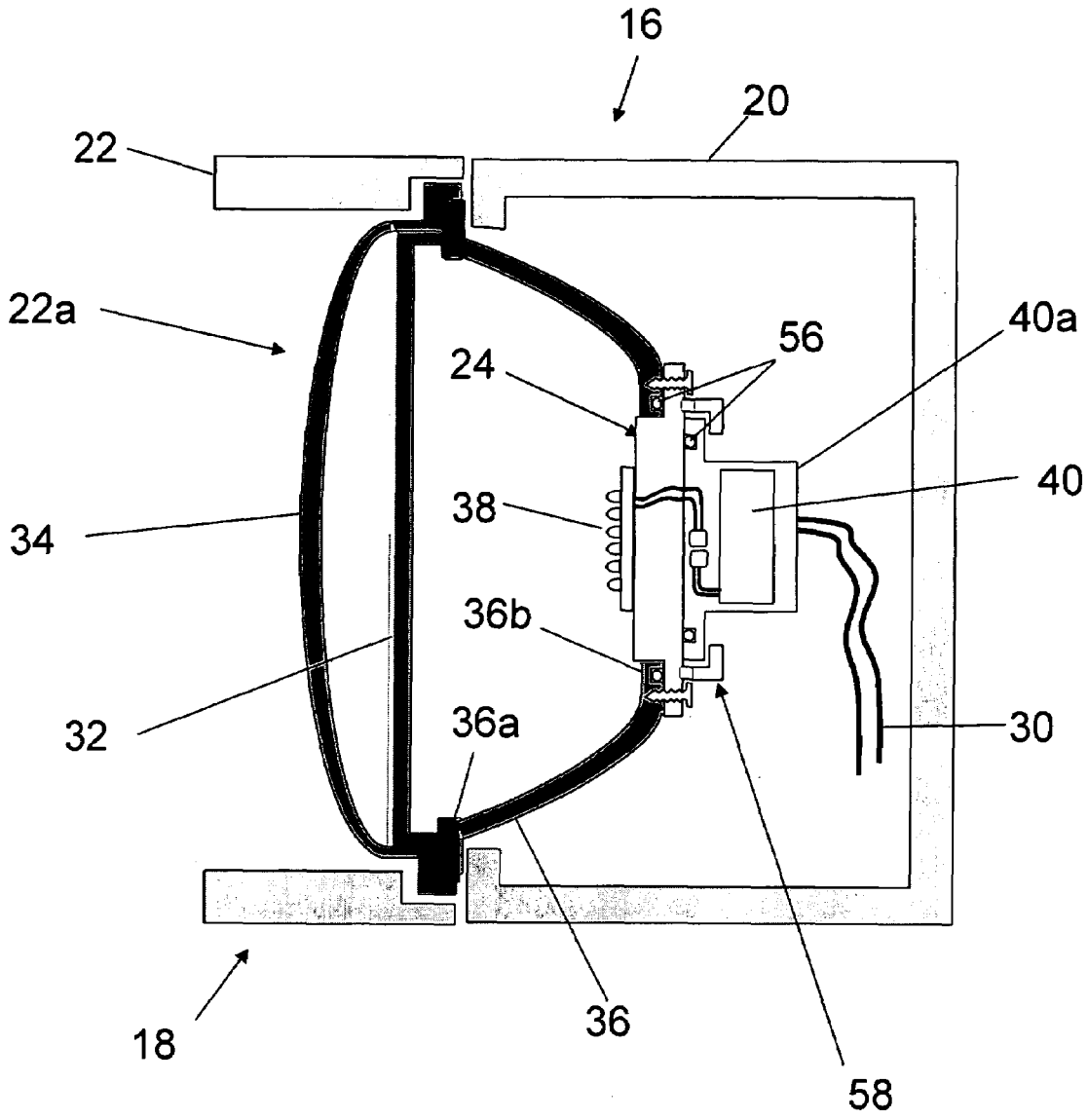
FIG. 8D is a side cross-sectional view of a fifth alternate embodiment of the traffic signal lamp assembly with the secured LED lamp module.
Figure 8E:
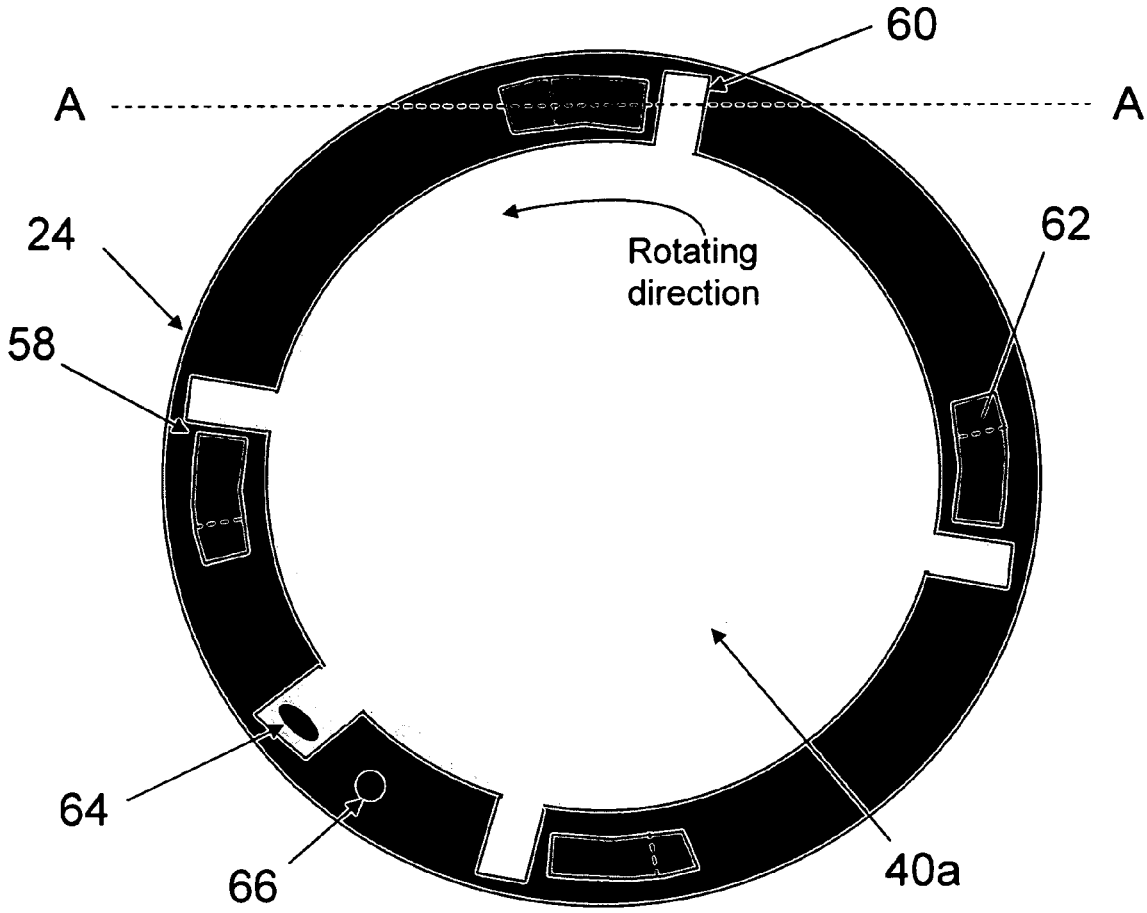
FIG. 8E is a rear view of the fifth alternate embodiment of the traffic signal lamp assembly with the secured LED lamp module.
Figure 8F:
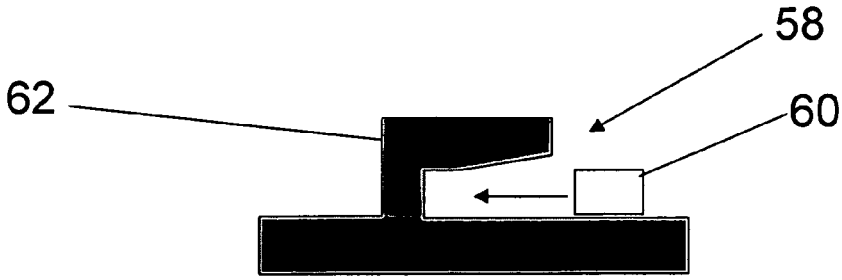
FIG. 8F is a side cross-sectional view taken along the line A-A in FIG. 8E, of the fifth alternate embodiment of the traffic signal lamp assembly with the secured LED lamp module.

FIGS. 8D-8F illustrate yet another embodiment similar to that of FIG. 8C, but where a locking mechanism 58 is used to secure the power supply housing 40*a* to the rest of the LED lamp module 24. The locking mechanism includes tabs 60 extending from the power supply housing 40*a*, and slot members 62 on the LED lamp module 24 main housing for receiving the tabs 60. To secure the power supply housing 40*a*, it is placed over the LED lamp module 24 main housing and then rotated until the tabs 60 enter into the slots formed by slot members 62. An optional tab 60*a*, having a hole 64, can be included that is disposed over a hole 66 in the LED lamp module 24 main housing when the rotation is complete. A screw or bolt can then be used to prevent any undesired counter-rotation that would result in inadvertent disengagement.

Figure 8G:
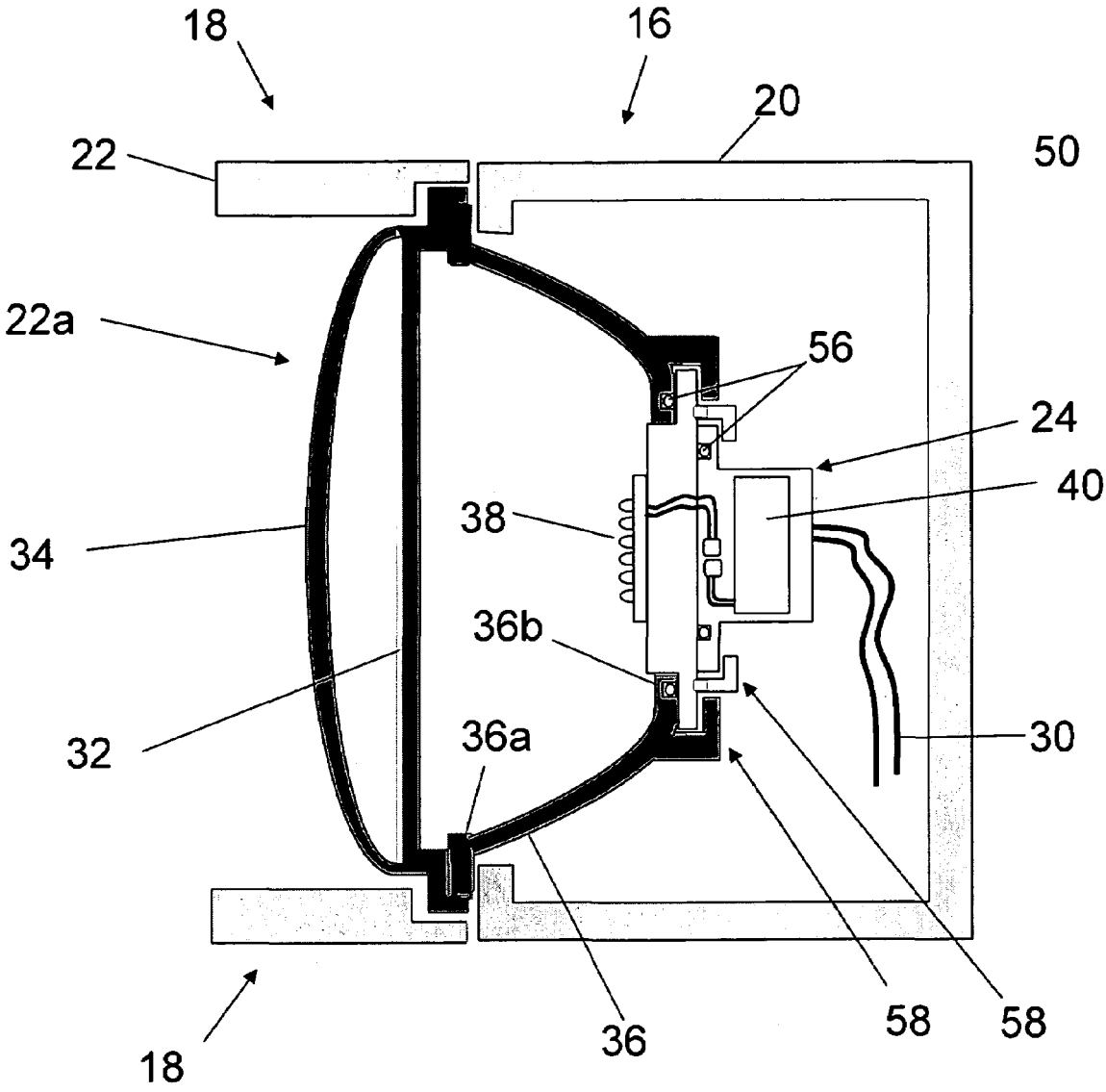
FIG. 8G is a side cross-sectional view of a sixth alternate embodiment of the traffic signal lamp assembly with the secured LED lamp module.

FIG. 8G illustrates another embodiment similar to that of FIGS. 8D-8F, but with a second locking mechanism 58 to secure the LED lamp module 24 main housing to the securing bracket 36.

Figure 9:
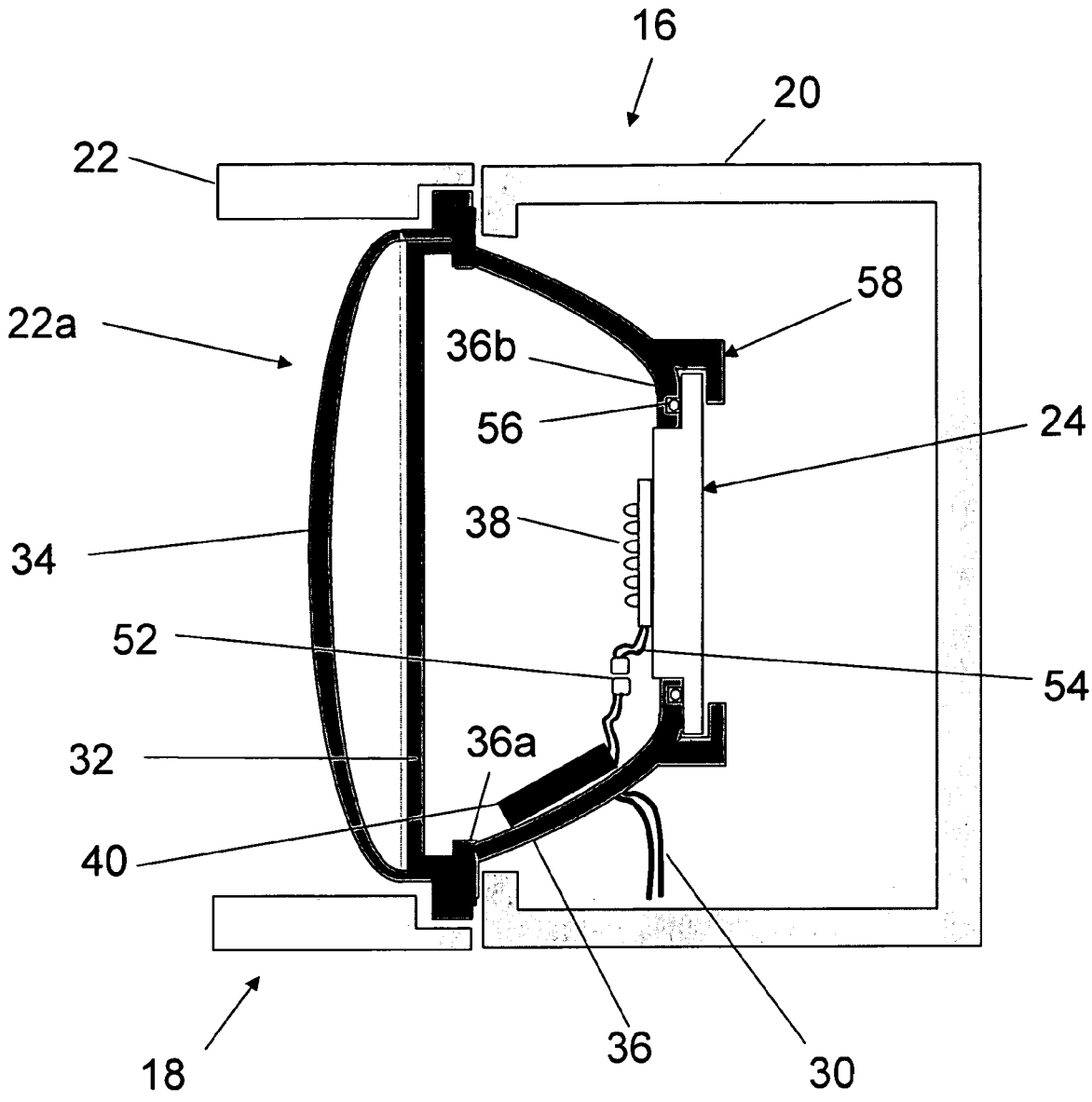
FIG. 9 is a side cross-sectional view of a seventh alternate embodiment of the traffic signal lamp assembly with the secured LED lamp module.

FIG. 9 illustrates still another alternate embodiment, which differs from that of FIG. 8G by mounting the power supply 40 inside the housing 20 (e.g. on the securing bracket 36 as shown) instead of inside the LED lamp module 24 itself. In this manner, the power supply 40 or LED lamp module 24 can be individually replaced should only one of them fail. A quick disconnect electrical connector 52 can be utilized on the wires 54 between the power supply 40 and LED lamp module 24 to facilitate removal of just one of these elements.

Figure 10:
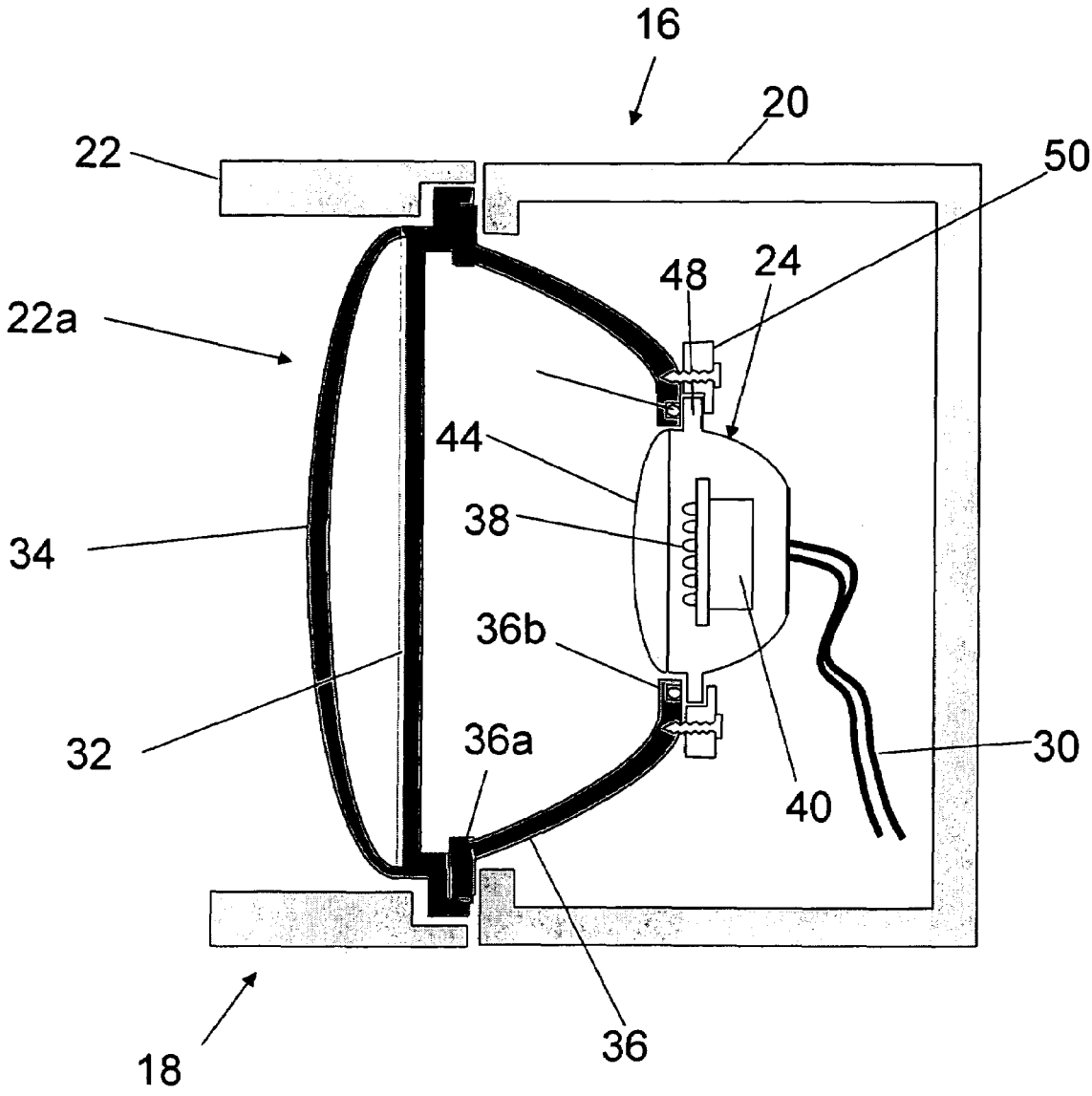
FIG. 10 is a side cross-sectional view of an eighth alternate embodiment of the traffic signal lamp assembly with the secured LED lamp module.

FIG. 10 illustrates one additional alternate embodiment, which differs from that of FIG. 6 in that LED lamp module 24 does not include the threaded electrical connector. Instead, the wires 30 enter the LED lamp module housing directly.

It is to be understood that the present invention is not limited to the embodiment(s) described above and illustrated herein, but encompasses any and all variations falling within the scope of the appended claims. One skilled in the art will appreciate that the methods described herein and/or claimed need not necessarily be performed in the order described/claimed.

What is claimed is:

1. A lamp assembly comprising:

a housing;

an LED lamp module disposed in the housing and including a plurality of LEDs for producing light;

a door assembly removably or movably attached to the housing and having an aperture for passing the light; and a securing bracket having a first end secured to the door assembly and a second end secured to the LED lamp module for maintaining an alignment between the door assembly and the LED lamp module, wherein the LED lamp module is secured to the securing bracket second end in a removable manner; and wherein the securing bracket is configured to:

engage with the LED lamp module as the door assembly is positioned in a closed position relative to the housing, and disengage with the LED lamp module as the door assembly is positioned in an opened position relative to the housing.

2. A lamp assembly comprising:

a housing;

an LED lamp module disposed in the housing and including a plurality of LEDs for producing light;

a door assembly removably or movably attached to the housing and having an aperture for passing the light; and a securing bracket having a first end secured to the door assembly and a second end secured to the LED lamp module for maintaining an alignment between the door assembly and the LED lamp module, wherein the securing bracket second end is ring shaped and removably engages with an annular side surface of the LED lamp module.

3. A lamp assembly comprising:

a housing;

an LED lamp module disposed in the housing and including a plurality of LEDs for producing light;

a door assembly removably or movably attached to the housing and having an aperture for passing the light; and a securing bracket having a first end secured to the door assembly and a second end secured to the LED lamp module for maintaining an alignment between the door assembly and the LED lamp module, wherein the securing bracket second end is ring shaped and removably engages with a flange extending from an annular side surface of the LED lamp module.

4. A method of retro-fitting a traffic signal lamp with an LED lamp, where the traffic signal lamp has a housing, a door assembly attached to the housing, a lens attached to the door assembly, a reflector in the housing, a threaded electrical socket connector in the housing, and a threaded light source connected into the socket connector, the method comprising:

removing the threaded light source from the threaded socket connector;

connecting a threaded LED lamp module into the threaded socket connector, wherein the LED lamp module includes a plurality of LEDs;

securing a first end of a securing bracket to the door assembly and securing a second end of the securing bracket to the LED lamp module for maintaining an alignment between the door assembly and the LED lamp module, where the securing of the securing bracket second end to the LED lamp module is performed in a removable manner and wherein the securing of the securing bracket second end to the LED lamp module includes:

engaging the securing bracket second end to the LED lamp module by positioning the door assembly in a closed position relative to the housing.

5. The method of claim 4, further comprising:

disengaging the securing bracket second end to the LED lamp module by positioning the door assembly in an opened position relative to the housing.

6. A method of retro-fitting a traffic signal lamp with an LED lamp, where the traffic signal lamp has a housing, a door assembly attached to the housing, a lens attached to the door assembly, an electrical connector in the housing, and a light source connected to the electrical connector, the method comprising:

disconnecting the light source from the electrical connector;

connecting an LED lamp module to the electrical connector, wherein the LED lamp module includes a plurality of LEDs;

securing a first end of a securing bracket to the door assembly and securing a second end of the securing bracket to the LED lamp module for maintaining an alignment between the door assembly and the LED lamp module, where the securing of the securing bracket second end to the LED lamp module is performed in a removable manner and wherein the securing of the securing bracket second end to the LED lamp module includes:

engaging the securing bracket second end to the LED lamp module by positioning the door assembly in a closed position relative to the housing.

7. The method of claim 6, further comprising:

disengaging the securing bracket second end to the LED lamp module by positioning the door assembly in an opened position relative to the housing.

* * * * *